US007789331B2

(12) United States Patent
Zehavi et al.

(10) Patent No.: US 7,789,331 B2
(45) Date of Patent: Sep. 7, 2010

(54) JET MILL PRODUCING FINE SILICON POWDER

(75) Inventors: Ranaan Zehavi, Sunnyvale, CA (US); James E. Boyle, Saratoga, CA (US)

(73) Assignee: Integrated Photovoltaics, Inc., Sunnyvale, CA (US)

( * ) Notice: Subject to any disclaimer, the term of this patent is extended or adjusted under 35 U.S.C. 154(b) by 152 days.

(21) Appl. No.: 11/782,201

(22) Filed: Jul. 24, 2007

(65) Prior Publication Data

US 2008/0054106 A1 Mar. 6, 2008

Related U.S. Application Data

(60) Provisional application No. 60/824,681, filed on Sep. 6, 2006.

(51) Int. Cl.
*B02C 19/06* (2006.01)

(52) U.S. Cl. ..... 241/5; 241/39

(58) Field of Classification Search ..... 241/5, 241/39

See application file for complete search history.

(56) References Cited

U.S. PATENT DOCUMENTS

| | | | | |
|---|---|---|---|---|
| 3,341,215 | A | 9/1967 | Spector et al. | |
| 3,425,638 | A * | 2/1969 | Becker et al. | 241/39 |
| 4,343,772 | A | 8/1982 | Frosch et al. | 422/200 |
| 4,691,866 | A | 9/1987 | Belk | 241/5 |
| 4,905,918 | A | 3/1990 | Selles et al. | |
| 5,164,138 | A * | 11/1992 | Dietl et al. | 264/600 |
| 5,346,141 | A | 9/1994 | Kim et al. | |
| 7,083,694 | B2 | 8/2006 | Boyle et al. | 156/89.11 |
| 2004/0042950 | A1 | 3/2004 | Mleczko et al. | 423/349 |
| 2004/0213955 | A1 | 10/2004 | Boyle et al. | |
| 2006/0105105 | A1 | 5/2006 | Ibrahim et al. | 427/248.1 |
| 2006/0211218 | A1 | 9/2006 | Boyle et al. | 438/455 |
| 2008/0029625 | A1 * | 2/2008 | Talton | 241/21 |

* cited by examiner

*Primary Examiner*—Mark Rosenbaum
(74) *Attorney, Agent, or Firm*—Law Offices of Charles Guenzer

(57) ABSTRACT

A method of jet milling silicon powder in which silicon pellets are fed into a jet mill producing a gas vortex in which the pellets are entrained and pulverized by collisions with each other or walls of the milling chamber. The chamber walls are advantageously formed of high-purity silicon as are other parts contacting the unground pellets or ground powder. The pellets and chamber parts may be formed of electronic grade silicon but polycrystalline silicon may be used for chamber parts. Additionally, the particle feed tube in which the particles are entrained in a gas flow and the vortex finder operating as the outlet at the center of the vortex may be formed of silicon. The milling and feed gas may be nitrogen supplied from a liquid-nitrogen tank lined with stainless steel. The feed pellets may be formed by chemical vapor deposition.

22 Claims, 3 Drawing Sheets

JET MILL PRODUCING FINE SILICON POWDER

RELATED APPLICATION

This application claims benefit of provisional application 60/824,681, filed Sep. 6, 2006.

FIELD OF THE INVENTION

The invention relates generally to grinding or pulverizing of materials. In particular, the invention relates jet milling of silicon powder and the resultant product.

BACKGROUND ART

Many processes require very small particles or powders of specific materials. In the past, powders could be produced by grinding and then sieving the ground particles to produce a powder of a desired size distribution. For most applications, the material of the grinding wheel can be chosen which introduces minimal contamination. Grinding, however, has proven insufficient for some advanced applications, particularly involving fine silicon powder of very high purity level and intended for use in different phases of the fabrication of silicon integrated circuits.

Boyle et al. in U.S. patent application publication 2004/0213955 A1, now issued as U.S. Pat. No. 6,083,694, describe a recently developed adhesive bonding together silicon parts for use in the fabrication of silicon electronic integrated circuits. The silicon parts are advantageously machined from electronic grade silicon (EGS), also called virgin polysilicon, of extremely high purity so as not to contaminate the semiconductor processing with which the assembled structure is used. Virgin poly is formed by the chemical vapor deposition of silane ($SiH_4$), trichlorosilane, or other silane compounds into generally free standing bodies. Other forms of polysilicon may be used, for example, randomly oriented polysilicon (ROPSi) grown by the Czochralski method from a randomly oriented seed. The adhesive is formed from a composite of a liquid silica-forming agent such as a spin-on glass (SOG) and fine silicon powder. After the silicon parts have been assembled with the adhesive applied to joints between the parts, the assembly is annealed at about 1000° C. to convert the silica-forming agent to silica, which apparently bonds the silicon particles to each other and to the adjacent silicon parts. It is greatly desired that the silicon powder used in the adhesive is pure enough so as to not compromise the cleanliness of the assembled silicon structure.

Silicon powder is commercially available from grinding EGS-grade silicon pellets. However, it purity level is compromised by the grinding process. Furthermore, the average particle size of the powder tends to be large, typically greater than 1 mm, and the size distribution is wide. The powder size determines the minimum clearance in the joint between parts. Generally, a small clearance and a minimum amount of adhesive in the joint are desirable. Further grinding and sieving can reduce the average size, but it becomes difficult to sieve powders below about 50 μm because of electrostatic attraction and van der Waals forces. Boyle et al. further describe the use of silicon nano-powder produced by a chemical vapor deposition (CVD) process of a vapor phase reaction of silane and hydrogen into small silicon particles of size of less than 100 nm, a size unobtainable by conventional grinding. However, it would be desirable to obtain a powder of selected size and with a narrow size distribution.

SUMMARY OF THE INVENTION

A method of milling fine silicon powder and the resultant product in which silicon pellets are fed into a jet mill having a gas vortex which entrains the pellets and causes them to pulverize by striking each other or walls of the chamber of the jet mill.

According to one aspect of the invention, walls of the milling chamber are formed of high purity silicon, for example, electronic grade silicon or randomly orientated polysilicon. Additionally, the pellet supply elements and powder extraction elements may be similarly formed of high purity silicon.

According to another aspect of the invention, high-purity milling gas is supplied from a tank of liquid nitrogen. The interior of the tank may be lined with stainless steel.

The silicon pellets are preferably composed of high purity silicon, for example having a total heavy and alkali metal impurity of less than 100 ppba, preferably less than 10 ppba. Such a high purity silicon is electronic grade silicon formed as pellets in a fluidized bed reactor.

DETAILED DESCRIPTION OF THE PREFERRED EMBODIMENTS

Figure 1:
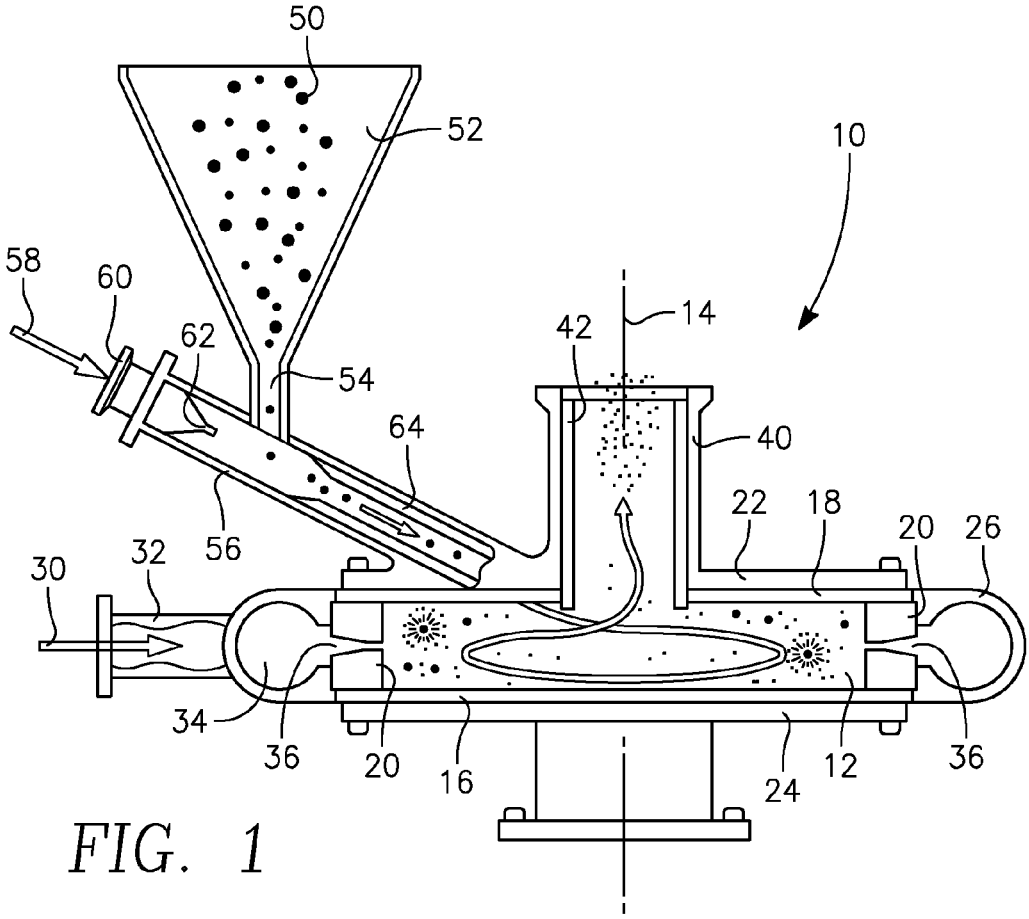
FIG. 1 is a partially sectioned view of a jet mill for pulverizing pellets into powder.

Jet milling may be used to pulverize silicon pellets into a fine silicon powder. Jet mills of differing capacities are available under the trade name Micronizer® from Sturtevant, Inc. of Hanover, Mass. The operation of such a jet mill 10 is illustrated in the partially sectioned view of FIG. 1. A generally cylindrically shaped milling chamber 12 is arranged around a chamber central axis 14 extending vertically in the illustrated embodiment and is defined by replaceable first and second axial liners 16, 18 and a replaceable circumferential liner 20 for lining the walls of the milling chamber 12. The liners 16, 18, 20 are held between first and second mill bodies 22, 24 also holding a circumferential mill body 26.

Compressed mill gas 30 is supplied through a gas intake 32 to an annular gas manifold 34 formed between the circumferential mill body 26 and the circumferential wall liner 20 and generally surrounding the milling chamber 12. A plurality, for example, six or eight of jet holes 36 inject the compressed mill gas 32 through the circumferential liner 20 into the outer periphery of the milling chamber 12. The jet holes 36 are all aligned within a common plane at a common inclined angle to respective radii in the plane to the chamber central axis 14 to thereby set up a circulating flow pattern, in particular a vortex of the mill gas 30 and other gas within the milling chamber 12. That is, the jet holes 36 are aligned along respective axes tangential to a circle within the milling chamber 12, for example, in the outer quarter of the chamber radius. The vortex, as illustrated by the curved line with an arrowhead, forms an inwardly directed spiral flow of the general shape of a cyclone beginning near the circumference of the milling chamber 12 about the central axis 14 and shrinking with continuously decreasing radius until it is close to the central axis 14 and an outlet 40 arranged around the central axis 14 on one axial side of the milling chamber 12 facing the eye of the cyclone. The outlet 40, which forms an extraction hole for the vortex gases and entrained particles, extends away from the milling chamber 12 along the chamber central axis 14. The gas in the vortex and any entrained particles are exhausted through the outlet 40 away from the milling chamber 12. A tubular vortex finder 42 fits snugly into the outlet 40 but is slidable along the chamber central axis 14 so that its bottom can be placed at a selected axial position adjacent to the vortex.

Pellets 50 of the desired material, in this case, silicon are loaded into a feed funnel 52 having a narrow feed orifice 54 at its bottom to slowly feed the pellets 50 into a feed tube 56, which is part of the upper mill body 22. The feed tube 56 is aligned at small angle with respect to the plane of the vortex and is directed to a tangent of the vortex near the circumferential liner 20. Compressed feed gas 58 is supplied to a feed gas inlet 60 having a nozzle 62 directing the feed gas 58 toward the pellets 50 falling with them through the feed orifice 54 of the funnel 52. The feed gas 58 entrains the pellets 50 and flows through the bore of a tubular supply liner 64 and through the upper wall liner 18 into the milling chamber 12. The liner 64 acts as an injector injecting the feed gas 58 and entrained pellets 50 into the vortex within the milling chamber 12.

The swirling vortex accelerates the pellets 50 into a generally circular path within the milling chamber 12. The pulverization of the material primarily occurs from particle-to-particle impact although some particles do strike the liners, particularly the circumferential liner 20. The tangential velocity of the vortex generally increases towards the chamber central axis 14. Centrifugal force drives larger particles towards the perimeter while fine particles are swept by the gas vortex and move toward the chamber central axis 14 and eventually exit the milling chamber 12 through the vortex finder 42 within the outlet 40 together with the two gases 30, 58.

Conventionally, the wall liners 16, 18, 20 are made of stainless steel although other materials are also conventionally used to reduce corrosion. However, we observe that for semiconductor applications, the heavy metals in stainless steel including iron, nickel, and chromium are likely to contaminate the silicon powder and eventually contaminate the silicon integrated circuit.

According to one aspect of the invention, the wall liners 16, 18, 20, supply liner 64, vortex finder 42 and other components to which the pellets 50 and milled powder are exposed, particularly at high velocity, are composed of silicon, preferably high-purity silicon. EGS-grade silicon, also known as virgin polysilicon, may be used. It has an extremely high purity level but tends to easily fracture. Boyle et al. describe the machining of EGS-grade silicon in U.S. Pat. No. 6,617,225 including a high-temperature anneal prior to machining. A silicon part or feed stock according to the invention has a silicon fraction of at least 95 at % although EGS-grade silicon is known to have heavy and alkali metal impurity levels of less than $10^{-9}$ atomic (1 ppba). However, other forms of silicon may be used to form the high-purity silicon chamber parts, such as cast silicon, plasma sprayed silicon, and either monocrystalline or polycrystalline Czochralski-grown silicon. An expecially convenient and inexpensive form of polysilicon is randomly oriented polysilicon (ROPSi) described by Boyle et al. in patent application 11/328,438, filed Jan. 9, 2006 and published as U.S. patent application publication 2006/0211128, incorporated herein by reference. ROPSi is grown from a silicon melt by the Czochralski method using a randomly oriented seed. Depending upon its growth conditions, it may need to be annealed prior to machining.

Figure 2:
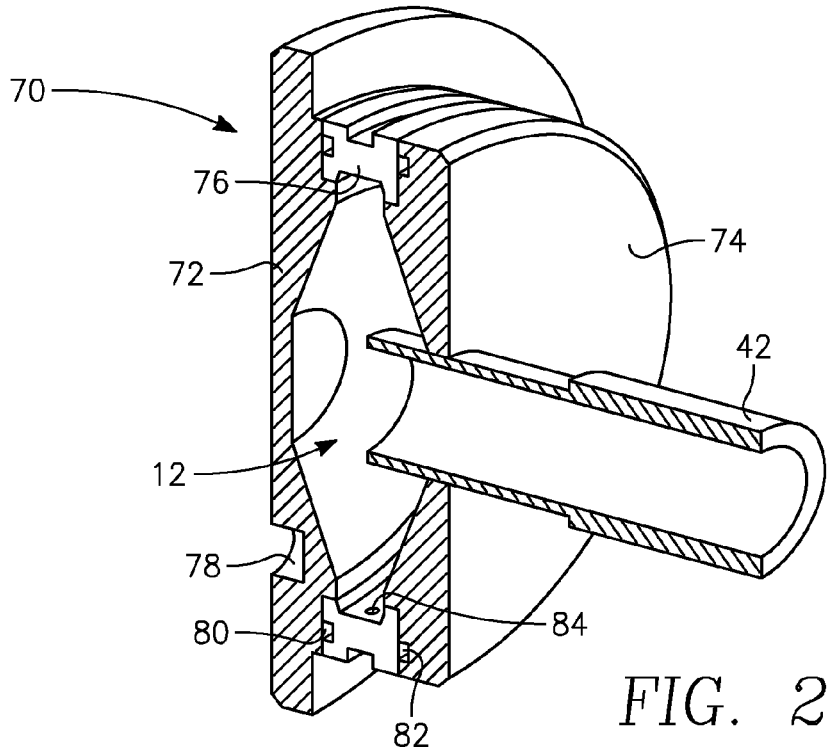
FIG. 2 is a sectioned orthographic view of the silicon liners and vortex finder usable with the invention.

An all-silicon liner assembly 70 including the first and second axial liners 72, 74 and a circumferential liner 76 for lining the walls of the milling chamber 12, and the vortex finder 42 is illustrated in more detail in the sectioned orthographic view of FIG. 2. The illustrated parts are designed for a variation of the jet mill 10 of FIG. 1. The liner assembly 70 is arranged around the horizontally extending central axis 14 of the jet mill 10 and the feed tube 56 is located on the side of the jet mill 10 and supplies feed stock into the milling chamber 12 through a slanted hole 78 formed in and through the first axial liner 72 but the vortex finder 42 is moved to the other side of the jet mill 10 and slidably fits through the second axial liner 74. Unillustrated retaining means hold the vortex finder 34 to one of the axial mill bodies at a selected slanted axial position. O-ring grooves 80, 82 in the circumferential liner 76 and the second axial liner 74 accept O-rings which seal the liners 72, 74, 76 together to form the gas-tight milling chamber 12 when the axial liners 72, 74 are snugly pressed together by hand toggles associated with the two mill bodies 20, 22 sandwiching the liner assembly 70 between them. The milling chamber 12 is formed into a fattened disk shape.

Figure 3:
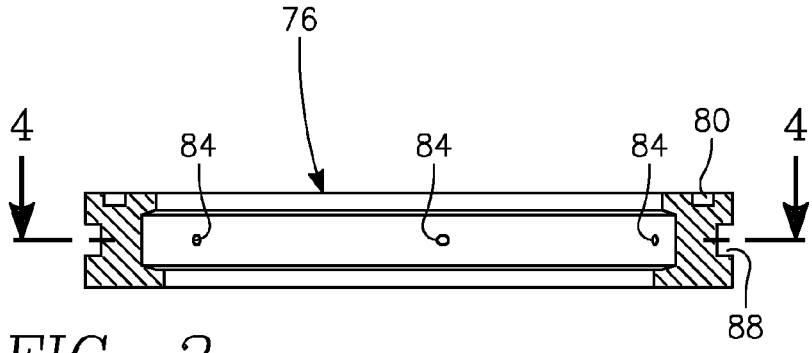
FIG. 3 is a cross-sectional view of part of a circumferential liner.
Figure 4:
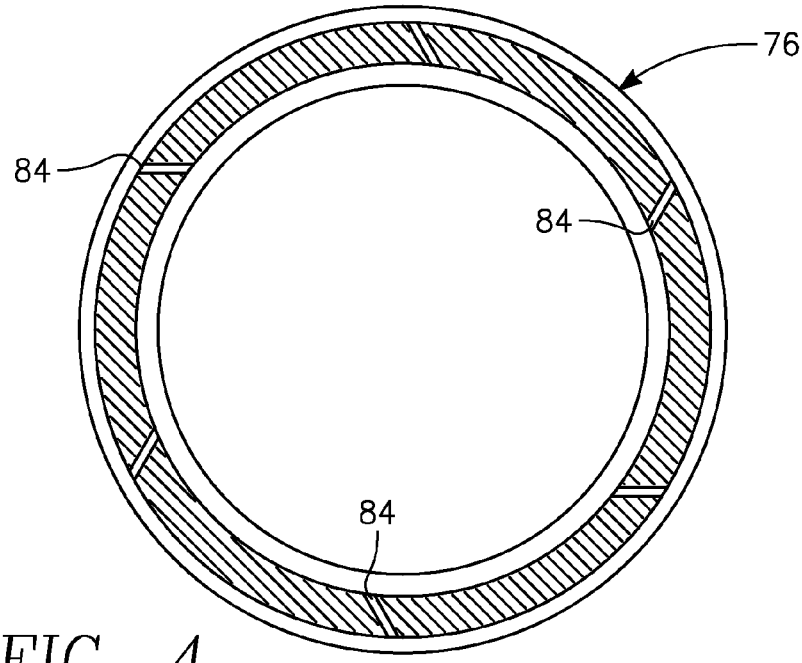
FIG. 4 is a cross-sectional view of the circumferential liner taken along section 4-4 of FIG. 3

The circumferential liner 76 is illustrated in FIG. 3 showing a cross-sectional view taken across the annular circumferential liner 76 and in FIG. 4 showing a cross-sectional view taken along section line 4-4 of FIG. 3. The circumferential liner 76 includes one or preferably more, for example, six jet inlets 84 spaced around the circumferential liner 76 and penetrating it along respective axes that are tangential to a common circle within the milling chamber 12 but inclined to respective radii at an angle between 10° to 80° , more preferably 20° to 50° , to set up the circulating vortex. The circumferential liner 76 includes an annular manifold groove 88 on its outer side communicating with all the jet inlets 86. The outer side of the circumferential liner 76 fits within the circumferential mill body 26 and is sealed to it with two O-rings on either side of the manifold groove 88 at a position along the mill body in which the mill gas intake penetrates. Thereby, the mill gas 30 is supplied into a manifold formed in the manifold groove 88 and distributed to all the jet inlets 84. The inclined jet inlets 84 cause the mill gas 30 to form a gas vortex within the milling chamber 12 about its horizontally arranged central axis 14.

Figure 5:
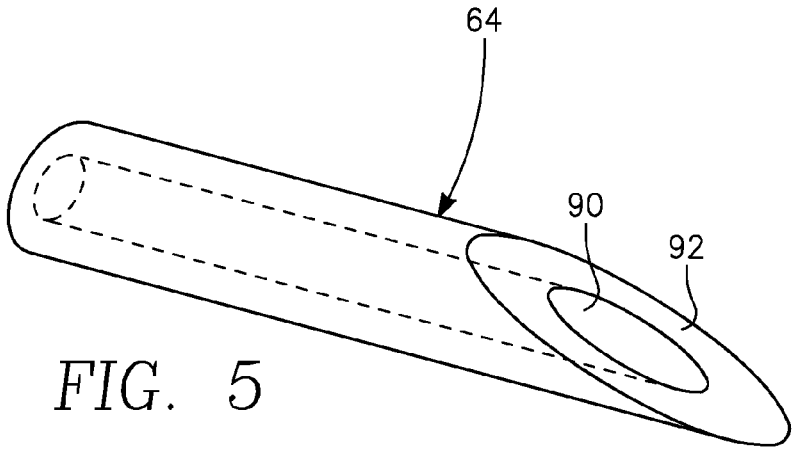
FIG. 5 is an orthographic view of a supply tube liner.

The silicon supply liner 64 is illustrated in the orthographic view of FIG. 5 and includes an axial bore 90 through which the feed gas 58 and pellets 50 are supplied from the funnel 52 into the milling chamber 12 through the inclined pellet inlet hole 78 in the first axial liner 72. A slanted end 92 of the supply liner 64 rests on the exterior of the first axial liner 72 around the exterior of the inclined pellet inlet hole 78.

Although most of the micronizing occurs as silicon particles collide, some particles strike the sides of the milling chamber 12 at high velocity. However, according to this aspect of the invention, the wall liners 16, 18, 20 or 72, 74, 76, the supply liner 64, and the vortex finder 42 are the only parts likely to be struck by high-speed silicon particles. Since they are all formed of high-purity silicon, the jet milling process is unlikely to contaminate the resultant silicon powder to lower purity levels than the silicon pellets 50 used as feed stock.

The funnel 52 may also be advantageously be made of high-purity silicon although in view of the low velocity of the silicon pellets 50 through it the funnel 52 may alternately be made of high-purity plastic.

Figure 6:
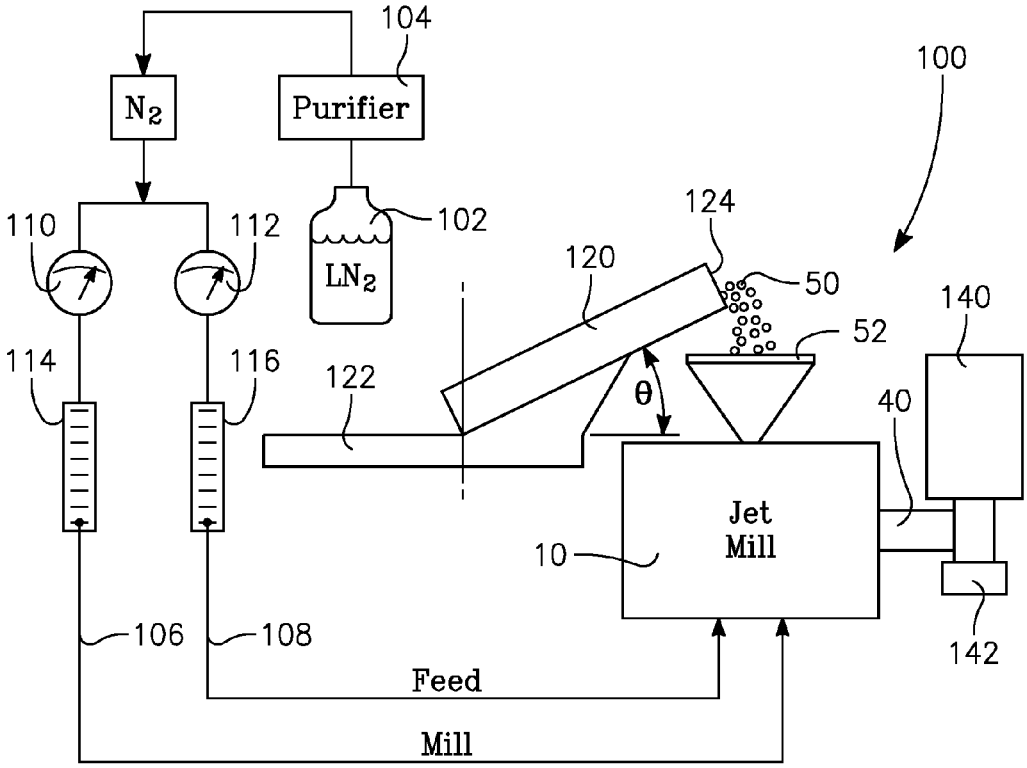
FIG. 6 is a schematic diagram of a jet milling system.

A jet milling system 100 is schematically illustrated in FIG. 6. The milling and feed gases should be very clean and dry and non-reactive with the silicon. Clean dry air can be used although fine silicon powder is subject to explosion in the presence of oxygen. Instead, high-purity nitrogen supplied from a liquid-nitrogen tank 102 is advantageously used for both the milling and feed gases. High-purity liquid nitrogen is available with gaseous impurities of no more than 0.01%. In one embodiment sized for a 2-inch (5 cm) Micronizer jet mill from Sturtevant, the liquid-nitrogen tank 102 supplies 10 cfm (283 liters per minute) of gaseous nitrogen at 130 psi (8.8 atmospheres). The liquid nitrogen supplied into the tank 102 should be ultra-pure and the interior of the tank 102, the gas lines, and the valves should all be made of stainless steel instead of the more conventional brass with gas-facing surfaces being polished. Other sources of pressurized high-purity nitrogen may be used. The nitrogen gas may be passed through a purifier 104 designed for inert gases such as the I-series GateKeeper® purifier available from Entegris using a nickel metallic filter medium. Care must be taken to exclude $H_2$, CO, $CO_2$, $O_2$, $H_2O$, and $SO_2$ from the purifier. The supply line is divided into a mill gas line 106 and a feed gas line 108 connected respectively to the mill gas inlet 32 and the feed gas inlet 60 of the jet mill 10. A milling pressure regulator 110 on the mill supply line 106 and a feed pressure regulator 112 on the feed gas line 108 selectably reduce the gas pressure to 60 to 80 psi (4 to 5.4 atmospheres). Mill and feed flow regulators 114, 116 selectably regulate the gas flows on the mill and feed supply lines 106, 108 to between 2.5 and 3 cfm (70 to 85 liters per minute). All gas lines, valves, and regulators should be ultra-clean, for example, made of stainless steel and free of brass and other contaminants, following practices used in the gas supply panels in the fabrication of semiconductor integrated circuits.

Figure 7:
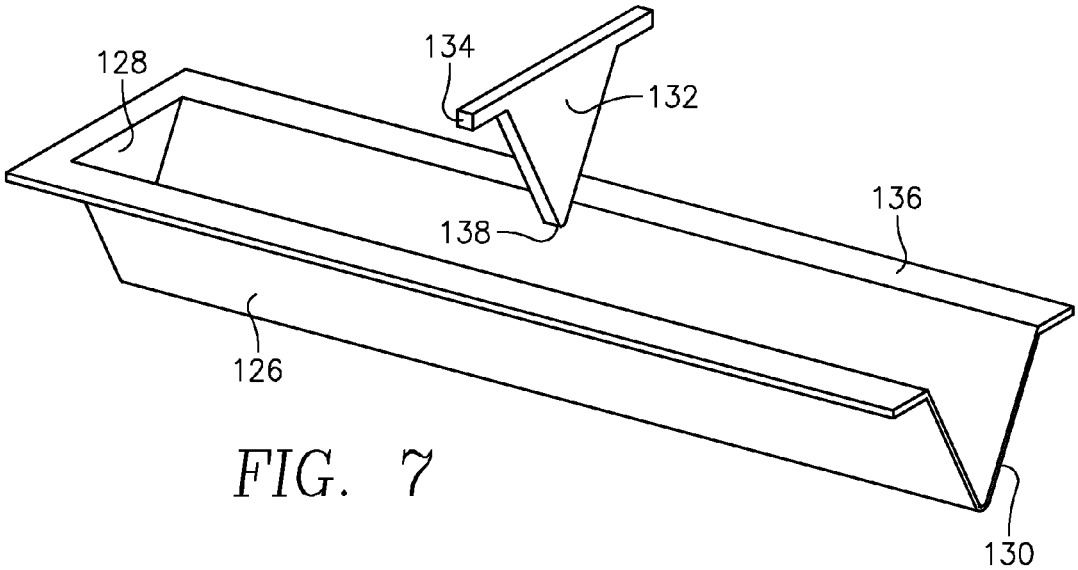
FIG. 7 is an orthographic view of parts of a feed trough used in the system of FIG. 6.

For small-scale production, the silicon pellets can be supplied from a feed trough 120 supported on vibrator 122 and tilted at a selected upward angle θ from the horizontal towards an open end 124 of the feed trough 120, for example, between 10° and 70° , more preferably 30° to 60° , with the open end 124 positioned over the funnel 52. As illustrated in the orthographic view of FIG. 7, a liner 126 for the feed trough 120 has a longitudinally extending V-shape with a closed end 128 and an open end 130 corresponding to the open end 124 of the feed trough 120. A dam 132 has two arms 134 for supporting the dam 132 on side flanges 136 of the liner 126. The dam 132 is clamped to the liner flanges 136 at a selected longitudinal position along the liner 136. The dam 132 has a truncated V-shape of similar slope as the liner 126 but has a bottom 138 which is truncated so the dam 132 does not completely close off the V-shaped liner 126. Silicon pellets 50 are loaded into the liner 126 between its closed end 128 and the dam 132. The truncated bottom 138 of the dam 132 assures that the pellets 50 are not agglomerated as they pass under the dam 132 but instead pass in a small stream beneath the dam 132. To eliminate any possible contamination, the liner 96 and dam 132 may also be composed of pure silicon although high-purity plastic may suffice. The vibrator 122, which may be a Syntron 101 available from FMC Technologies of Homer City, Pennsylvania, vibrates the trough 120 and attached liner 126 at low frequency and with a controllable amplitude. The vibration causes the pellets 50 loaded in back side of the dam 132 to move essentially in single file up the tilted feed trough 120 as if marching uphill and drop out the open end 130 of the liner 126 into the funnel 52 positioned beneath the open end 130. The feed rate can be closely controlled by a combination of the tilt angle θand the amplitude of vibration. Alternatively, a feed screw fabricated of high-purity materials may provide for extended unattended supply of pellets.

Returning to FIG. 6, the outlet 40 of the jet mill 10, lined by the silicon vortex finder 42, is connected to the inlet of a HEPA gas filter 140 arranged around a vertical axis and below which a collecting jar 142 collects the powder blocked by the gas filter 140. For high-production applications, commercial dust collectors with high-purity, especially silicon, parts may be substituted. The piping of the collection system may be formed of high-quality and high-purity plastic such as Delrin or Teflon but piping and the collection jar 142 may advantageously be formed of high-purity silicon.

The particle size can be controlled by varying the gas feed pressure, the flow rates for the feed and mill gases, the position of the vortex finder, the size of the silicon pellets, and the feed rate of the pellets into the mill. We have been able to achieve a narrow size distribution of 0.2 to 20 micron.

Tighter size distributions could be achieved interposing a hydrocyclone between the jet mill and the powder collection apparatus. Hydrocylones utilizing centrifugal sedimentation are available from Particle Sizing Systems, Inc. of Santa Barbara, California under the trade name SuperClone but may need to be modified with silicon parts. A sieve may also be used to separate out the larger particles. For example, a 635 nylon mesh will capture any milled particles larger than 20 microns although nylon sieves presents problems with electrostatic clogging.

The pellets 50 should be of high-purity silicon, preferably EGS-grade silicon. Virgin polysilicon broken from ingots of CVD-grown silicon can be ground small enough to act as feed stock. Czochralski silicon of high purity may also be broken down into the feed stock. A preferred feed stock is granular polysilicon manufactured by MEMC Electronic Materials, Inc. of St. Louis, Mo. or Wacker Solitec of Burghausen, Germany. Such granular polysilicon has the appearance of BBs with generally spherical shapes and having diameters between about 0.15 mm to 2.5 mm with an average of about 0.7 to 0.75 mm. Total transition metal impurity is less than 100 ppba (parts per billion atomic), preferably less than 10 ppba. The granular polysilicon is grown by a CVD process from silane or chlorosilane and hydrogen in a fluidized bed reactor using silicon powder as a seed.

The highly pure silicon powder of small size and narrow distribution producible with the invention is advantageously used as the silicon component of the composite adhesive used to join silicon parts. The high purity silicon powder cannot contaminate the semiconductor processing chamber in which the assembled structure is used. The small size provides for a large surface area of silicon and the narrow size distribution allows the clearance between joint edges to be small, thereby easing assembly and alignment as well as reducing the amount of adhesive used.

Another use of silicon powder is the plasma spraying of silicon for joining silicon parts, as described by Boyle et al. in U.S. Pat. No. 7,074,693 and other sealing applications for silicon structures. Yet another application includes plasma spraying of semiconducting silicon, for example, to form solar cells. In plasma spraying, silicon powder is fed into a plasma spray gun, which vaporizes it in a plasma stream, for example of argon, directed at the joint or part being sprayed. When the silicon part or assembly is being used in semiconductor fabrication, the sprayed silicon needs to be essentially free of contaminants, especially heavy metals. For forming a semiconducting silicon device such as a solar cell, the silicon must be of high purity. The silicon powder of the invention satisfies these requirements. The silicon powder may also need to be doped with semiconductor dopants of a chosen dopant type and doping concentration.

Some application would benefit from the plasma spraying of doped silicon, for example, to control the electrical resistivity or optical transmittance of the sprayed layer or in forming solar cells. Hence, it would benefit to produce silicon powder having the desired semiconductor doping. It is possible to adjust the process producing the silicon pellets to have the desired doping levels. EGS-grade silicon can be grown with the desired doping by the addition of conventional doping gases in the CVD process. However, this is not conventionally done since EGS-grade silicon is produced to be free of all contaminants. Czocharalski-grown silicon is more conventionally grown with a controlled semiconductor doping. However, an entire ingot of virgin polysilicon would need to be so grown or the fluidized bed apparatus would need to be converted to accept a doping gas. An alternative or additional technique dopes the liners of the jet mill with the desired dopant. Some of the doped liner material will mix with the milled powder and produce a silicon powder incorporating the desired dopant.

The jet mill of the invention is not limited to the illustrated embodiment. A jet mill can be defined as a milling apparatus in which a feed stock to be milled is entrained in a flow of gas a majority of the milling occurs as particles within the flow collide with each other such that multiple steps of reduction of particle size occurs. A circulating gas flow, such as the described vortex, increases the interaction length for collision between particles. The feed stock pellets need not be entrained in a separate gas flow and could drop unassisted into the milling chamber. The feed inlet may be formed in the side wall. A separate and adjustable vortex finder is not required.

The invention allows the inexpensive production of high-purity silicon powder of tight size distribution. Further, a jet mill conforming to the invention can be easily implemented with retrofitting of a few parts on existing commercially available equipment.

The invention claimed is:

1. A method of milling silicon powder, comprising the steps of:

creating a circulating flow of gas about a central axis in a milling chamber having walls and including removable silicon liners placeable and removable from the walls of the milling chamber;

storing silicon particles in a storage container having elemental silicon surfaces;

injecting the silicon particles from the storage container into the circulating flow;

extracting an exit gas flow along the central axis from a central region of the circulating flow; and removing solid material from the exit gas flow.

2. The method of claim 1, wherein the silicon particles are formed in a process of chemical vapor deposition.

3. The method of claim 2, wherein the process includes a fluidized bed for producing the silicon particles.

4. The method of claim 3, wherein the silicon particles are generally spherically shaped, a majority of which have diameters in a range of 0.15 to 2.5 mm.

5. The method of claim 2, wherein the silicon particles have a metal impurity level of less than 100 ppba.

6. The method of claim 1, wherein the circulating flow comprises a vortex about the central axis and the chamber is generally cylindrically shaped about the central axis.

7. The method of claim 1, wherein the gas consists essentially of nitrogen drawn from a source of liquid nitrogen and has gaseous impurities of no more than 0.01%.

8. The method of claim 7, wherein the source of liquid nitrogen comprises a tank with a stainless steel interior.

9. The method of claim 1, further comprising entraining the particles in the flow of a gas injected into the circulating flow through a silicon injector.

10. The method of claim 1, wherein the solid material extracted from the flow has a size distribution of less than 20 microns.

11. The method of claim 1, further comprising plasma spraying the solid material to form a semiconducting device.

12. The method of claim 11, wherein the semiconducting device is a solar cell.

13. The method of claim 1, wherein the storage container comprises a V-shaped trough having an open end, and further comprising vibrating the trough to cause the silicon particles in the trough to drop out the open end into a funnel disposed between the open end and a feed hole to the milling chamber.

14. A silicon jet mill, including:

a storage container having silicon surfaces adapted to store feed pellets;

a milling chamber arranged generally symmetrically about a central axis and including an outer milling chamber with a circumferential wall and two axis walls and removable silicon wall liners placeable over and removable from the circumferential walls and two axial walls;

a plurality of gas inlets through the circumferential wall capable of creating a circulating gas flow in the milling chamber about the central axis;

a feed hole supplied with the feed pellets from the storage container and formed in one of the wall liners away from the central axis; and an extraction hole formed around and extending along the central axis in one of the axial wall liners.

15. The silicon jet mill of claim 14, wherein the storage container comprises a V-shaped trough having an open end, and further comprising a funnel disposed between the open end and the feed hole.

16. The mill of claim 14, wherein the silicon wall liners comprise a generally cylindrical silicon circumferential liner and two silicon axial liners.

17. The mill of claim 14, wherein the milling chamber is generally cylindrically shaped and the circulating gas flow comprises a vortex about the central axis.

18. The mill of claim 14, wherein the feed hole is connected to a gas supply through a feed tube and the feed tube includes an aperture in a side wall thereof through which the feed pellets may be injected into the feed tube and having the feed hole at an end of the feed tube.

19. The mill of claim 14, wherein the gas inlets are aligned along respective axes tangential to a circle disposed within the milling chamber about the central axis.

20. The mill of claim 14, further comprising a silicon liner disposed within the extraction hole.

21. The mill of claim 14, further comprising a particle separator connected to an output gas flow path from the extraction hole and capable of separating particles and gas from a flow along the output gas flow path.

22. The mill of claim 14, further comprising a particle filter connected to the extraction hole.

* * * * *